US007845632B2

(12) United States Patent
Windsor et al.

(10) Patent No.: US 7,845,632 B2
(45) Date of Patent: Dec. 7, 2010

(54) MEDIA FEEDING AND WIDTH SENSING METHODS AND APPARATUS FOR PRINTING SYSTEMS

(75) Inventors: Michael Ross Windsor, Watford (GB); Richard T. C. Bridges, Palmers Green (GB)

(73) Assignee: Xerox Corporation, Stamford, CT (US)

( * ) Notice: Subject to any disclaimer, the term of this patent is extended or adjusted under 35 U.S.C. 154(b) by 1045 days.

(21) Appl. No.: 11/563,341

(22) Filed: Nov. 27, 2006

(65) Prior Publication Data

US 2008/0122163 A1 May 29, 2008

(51) Int. Cl.
*B65H 1/00* (2006.01)

(52) U.S. Cl. ..... 271/171

(58) Field of Classification Search ..... 271/171
See application file for complete search history.

(56) References Cited

U.S. PATENT DOCUMENTS 4,294,535 A * 10/1981 Ariyama et al. ..... 399/394
4,780,740 A * 10/1988 Fukae ..... 399/86
5,689,759 A * 11/1997 Isemura et al. ..... 399/45
5,826,156 A 10/1998 Natsume et al.
5,875,033 A 2/1999 Kawata et al.
5,940,106 A * 8/1999 Walker ..... 347/104
6,014,229 A * 1/2000 Yun ..... 358/449
6,070,048 A 5/2000 Nonaka et al.
6,073,925 A * 6/2000 Sato ..... 271/171
6,092,799 A * 7/2000 Koike ..... 271/3.02
6,401,606 B1 * 6/2002 Sato ..... 101/118
7,441,769 B2 * 10/2008 Miki ..... 271/171
2006/0267270 A1 * 11/2006 Suzuki et al. ..... 271/171

* cited by examiner

*Primary Examiner*—Stefanos Karmis
*Assistant Examiner*—Howard Sanders
(74) *Attorney, Agent, or Firm*—Fay Sharpe LLP

(57) ABSTRACT

Systems and methods for feeding media into a printing system in which a movable media guide is used to register media on a tray with a potentiometer and an opto-interrupt sensor are mounted in a fixed position relative to the tray with the slidable potentiometer member being moved by translation of the media guide. An obstruction structure is coupled to move relative to the opto-interrupt sensor when the media guide is translated and provides one or more fins to selectively block or open the optical signal path of the opto-interrupt sensor, with the sensed media width being determined according to the output signals of the opto-interrupt sensor and the potentiometer.

22 Claims, 10 Drawing Sheets

MEDIA FEEDING AND WIDTH SENSING METHODS AND APPARATUS FOR PRINTING SYSTEMS

BACKGROUND

Printing systems such as copiers, printers, facsimile devices or other systems having a print engine for creating visual images, graphics, texts, etc. on a page or other printable medium typically include various feeding systems for introducing original image media or printable media into the system. Examples include document feeders into or onto which a user inserts original documents from which images are obtained, as well as so-called bypass trays for introducing printable media into a printing system. These media feeders typically include media guide structures with which the inserted media is registered by moving one or both of the guides to engage opposite sides of the media, thereby fixing the location of the media relative to the entry path into the system. Advanced printing systems often provide for automatic or semi-automatic identification of the width of the inserted media according to the relative location of the media guides, and use the size information for further processing of the media within the system. Conventional approaches for media width identification include manual identification with no sensing, wherein a user is prompted to input the media size and orientation, provision of a series of opto-interrupt sensors with sensor flag arrays connected to moving guides, as well as use of potentiometers connected to one or both of the moving media guides. However, the resolution of these automated width measurements systems is limited and is subject to mechanical and electrical tolerance variations, whereby discriminating between standard media sizes is often difficult and these systems typically require calibration procedures to ensure correct identification of the inserted media width. Thus, there remains a need for improved media feeding and width sensing techniques and apparatus by which the automatic or semi-automatic determination of media width can be improved and by which the need for width sensing system calibration can be mitigated.

BRIEF DESCRIPTION

Methods and systems are presented herein for feeding original image media and/or printable media into a printing system and for determining the width of the inserted media. In one embodiment, a printing system media feeding apparatus is provided, including a tray to support media being fed into the system with first and second media guides, at least one of which is movable to engage opposite sides of the media between the guides. A potentiometer is mounted in a fixed position relative to the tray with a slidable member operatively coupled to move relative to the base when the first media guide is moved relative to the tray, with the potentiometer providing an electrical output signal indicative of the relative position of the first media guide and the tray. An opto-interrupt sensor is mounted in a fixed position relative to the tray, with a signal source providing an optical signal along an optical signal path and an optical signal detector spaced from the optical signal source by an optical sensing gap, where the sensor provides an electrical output signal indicative of the presence or absence of an optical obstruction in the gap. The feeding apparatus also includes an optical obstruction structure with one or more fins or vanes is operatively coupled to the movable media guide so as to move relative to the opto-interrupt sensor when the guide is moved relative to the tray with the fin or fins moving within the optical sensing gap to block the optical signal path for a first portion of the movement or adjustment range of the first media guide and to allow receipt of the optical signal by the optical signal detector for a second portion of the movement range of the first media guide.

In one possible implementation, both media guides are movable along an axis in synchronism via a rack and pinion system and when pushed together, the guides centrally register the inserted media in the tray. The slider of the potentiometer is biased against a profile edge of a rack connected to the first media guide, and the rack provides the obstruction fin or fins to selectively open or close the optical signal path of the opto-interrupt sensor as the guide is moved, wherein the output signals of the potentiometer and the opto-interrupt sensor are used to determine the width of the inserted media. In certain examples, the profile of the ramp structure edge includes two or more profile portions to move the potentiometer slider in a first direction as the first media guide is moved in the first portion of the movement range and to move the slidable member in the opposite direction as the guide is moved in the second portion of the movement range, with the opto-interrupt sensor providing different Boolean output states to differentiate between the movement range portions. In this manner, the effective range of the potentiometer can be utilized twice or even more to increase the resolution capability of the media width sensing apparatus.

In other implementations, the obstruction structure can provide two or more fins interacting with the optical sensor, by which the width sensing system is able to differentiate between three or more media width regions to identify a list of likely media widths. These identified widths can then be rendered to an operator interface for final selection of the actual media size by the user, with the obstruction fin positions and lengths being tailored to distinguish standard media sizes without requiring system calibration. Further implementations may include two or more opto-interrupt sensors with corresponding obstruction structures.

Other embodiments of the disclosure provide a system for determining a width of media registered between first and second media guides in a feeding tray of a printing system. The width determination system includes a potentiometer with a base mounted in a fixed position relative to the tray with a slidable member operatively coupled to move relative to the base when the first media guide is moved relative to the tray, as well as an opto-interrupt sensor mounted in a fixed position relative to the tray and an optical obstruction structure that moves relative to the sensor when the media guide moves relative to the tray. A media width sensing or detection system is operatively coupled with the potentiometer and the opto-interrupt sensor to determine the media width based at least partially on the electrical output signals from the potentiometer and the opto-interrupt sensor.

Further embodiments provide a method for determining a media width in a printing system. The method comprises providing a tray with first and second media guides, mounting a potentiometer in a fixed position relative to the tray with a slidable member operatively coupled to move when the first media guide is moved. The method further comprises mounting an opto-interrupt sensor in a fixed position relative to the tray, and mounting an optical obstruction structure in a fixed position relative to the first media guide to move relative to the opto-interrupt sensor when the first media guide is moved relative to the tray. The first media guide is then moved to register the media and first and second electrical signals are read from the potentiometer and the opto-interrupt sensor, with the media width being determined based at least partially on the first and second electrical signals. In certain implementations, the width determination may include determining two or more possible media widths based on the electrical output signals from the potentiometer and the opto-interrupt sensor, rendering a selection of the plurality of possible media widths to a user, and determining the media width based on a user selection from a user interface of the printing system.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 4:
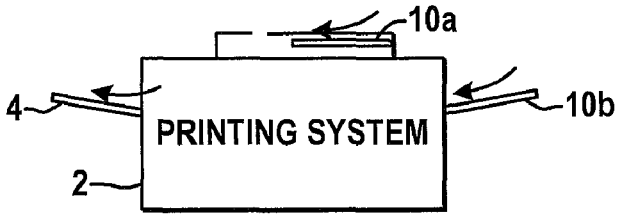
FIG. 4 is a simplified side elevation view illustrating a printing system having a first feeding apparatus for introducing original media into the printing system and a bypass tray feeding apparatus for introducing printable media into the system.

Referring now to the drawings, wherein the various structures and features are not necessarily drawn to scale, FIG. 4 depicts a printing machine or printing system 2 with an output tray 4 which receives printed media, as well as media feeding apparatus 10 for introducing media into the system 2. One feeding apparatus 10*a* operates to feed original media into the printing system 2 and a second apparatus 10*b* is a bypass tray for introducing printable media into the system 2. The printing system 2 can be any form of copier, printer, facsimile machine, or other system having one or more print engines or components by which visual images, graphics, text, etc., are printed on a page or other printable media, including xerographic, electro photographic, and other types of printing technology, wherein such components are not specifically illustrated to avoid obscuring the various media feeding and width determination features of the present disclosure. In general, the media feeders and width detecting systems find particular utility in the printing arts and more particularly in electro photographic or xerographic printing systems 2 in which a photoconductive surface is charged to a substantially uniform potential and is then exposed to record an electrostatic latent image corresponding to an original document or image to be reproduced. Subsequently, a developer material is provided to the latent image in a development zone and toner particles are attracted from the developer onto the latent image. The toner image is then transferred to a copy sheet or other printable media and affixed thereto, wherein such original image media and printable media may be introduced or fed into the system 2 and the width or size thereof determined using the exemplary apparatus and methods of the present disclosure.

Figure 1:
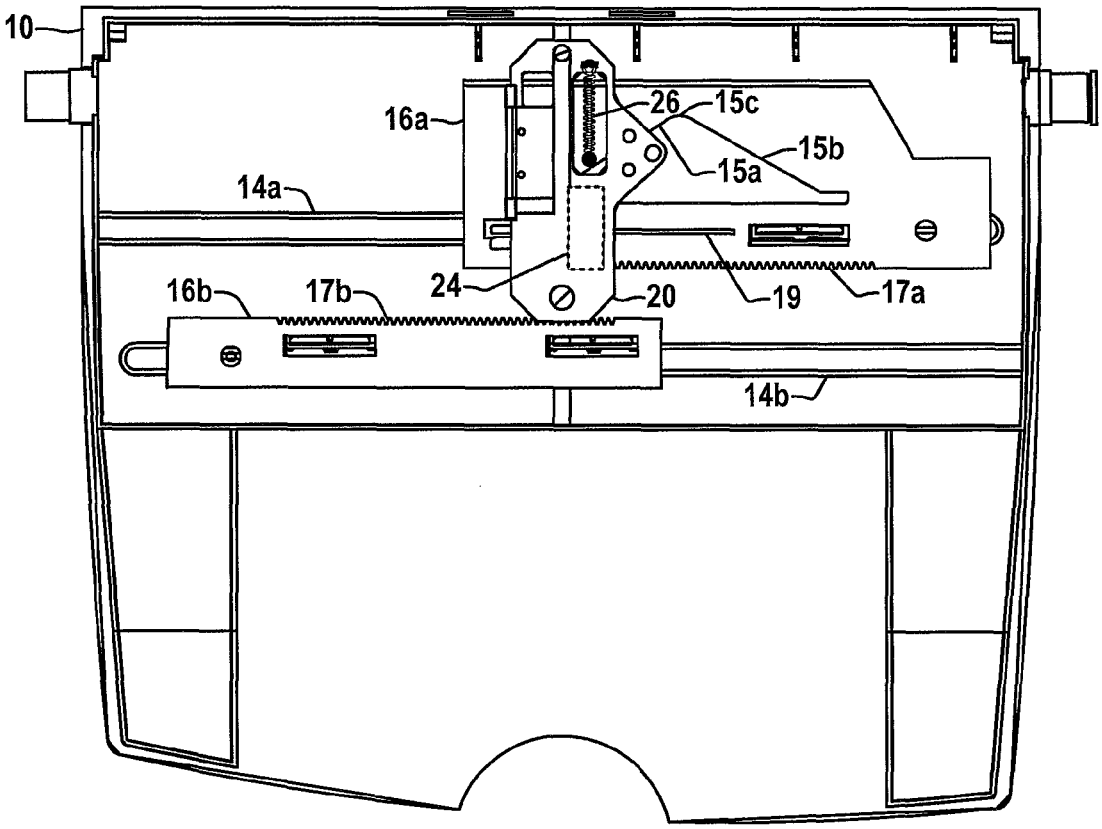
FIG. 1 is a bottom plan view illustrating a printing system feeding apparatus including a tray and an exemplary media width sensing apparatus with a potentiometer and an opto-interrupt sensor.
Figure 2:
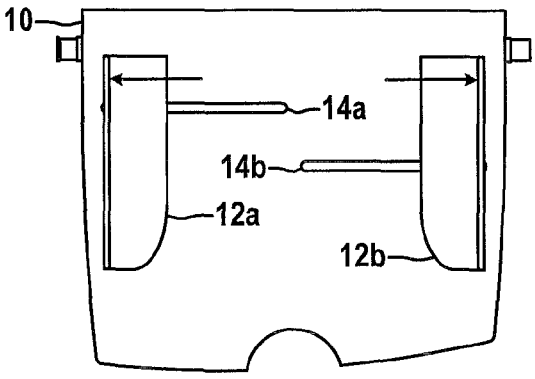
FIGS. 2 and 3 are top plan views illustrating the feeding apparatus with a pair of movable media guides in two exemplary positions.
Figure 3:
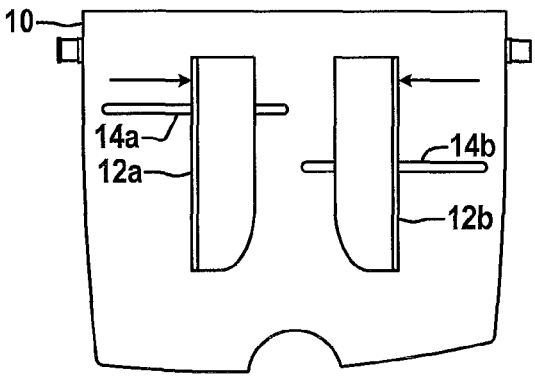
Figure 5:
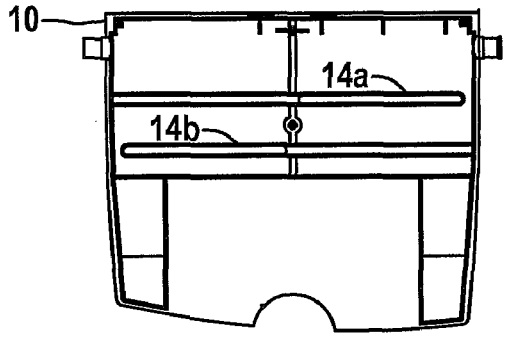
FIG. 5 is a bottom plan view illustrating the tray of the exemplary feeding apparatus.
Figure 6:
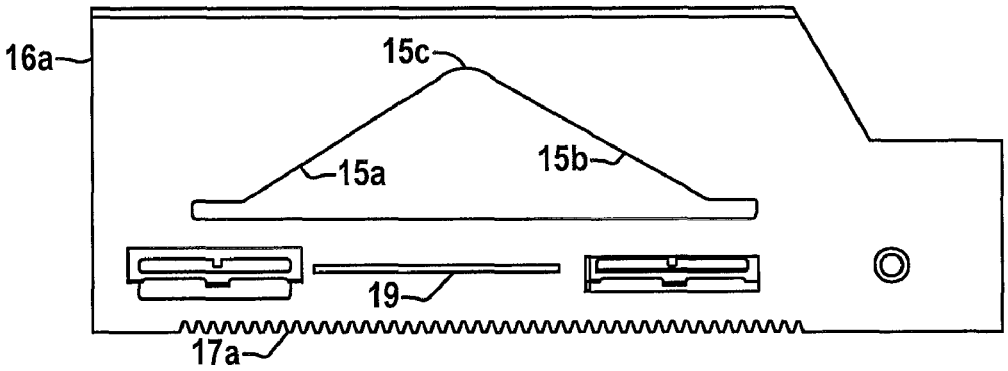
FIG. 6 is a bottom plan view illustrating an exemplary first rack associated with the first media guide in the feeding apparatus and having a dual ramp profile edge for translating a potentiometer slide and an obstruction structure with a fin for selectively blocking or unblocking a signal path of an opto-interrupt sensor.
Figure 7:
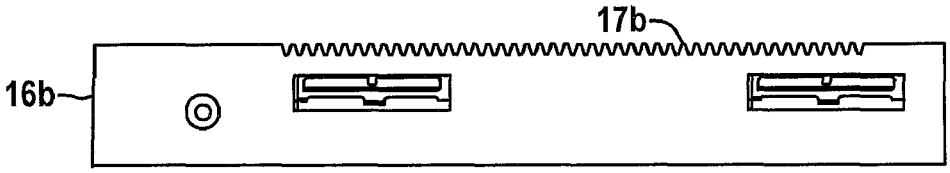
FIG. 7 is a bottom plan view illustrating an exemplary second rack associated with the second media guide in the feeding apparatus.

FIGS. 1-3 and 5-9 illustrate an exemplary printing system feeding apparatus including a multi-sheet inserter tray 10 with first and second movable media guides 12*a* and 12*b* moveable together in opposite directions along first and second slots 14*a* and 14*b*, respectively. As best seen in FIG. 1, the guides 12*a* and 12*b* are mounted to first and second racks 16*a* and 16*b* coupled by a pinion gear (not shown) on the bottom side of the tray 10 that cooperatively provide for synchronous translation of the guides 12 in a rack and pinion arrangement by which the guides 12 can be pushed together to centrally register a media stack in the tray 10 and for any given stack width the guides 12 will move to a known position. The media feeding system further includes media width sensing apparatus with a potentiometer 22 and an opto-interrupt sensor 24 providing electrical signals used to define the position of the first (e.g. upper) rack 16*a* and thus to ascertain the width of registered media between the media guides 12*a* and 12*b*. FIG. 5 shows the bottom side of the tray 10 including the first and second slots 14*a* and 14*b*, and FIGS. 6 and 7 show the exemplary first and second racks 16*a* and 16*b* that are mountable to the media guides 12*a* and 12*b* using screws extending through the tray slots 14*a* and 14*b*, respectively, where the racks 16*a* and 16*b* include teeth 17*a* and 17*b* for cooperative engagement with a pinion gear (not shown) for synchronous movement in opposite directions along an axial direction parallel to the slots 14 and generally perpendicular to the media feed direction in this example. As best seen in FIG. 6, the first rack 16*a* provides a ramp structure mounted in a fixed position relative to the first media guide 12*a* and having an edge 15 with a profile for engaging a slidable member 23 of the potentiometer 22, where the profile of the rack edge 15 includes first and second profile portions 15*a* and 15*b* and a radius center 15*c*. In this example, moreover, the profile portions 15*a* and 15*b* are substantially straight or linear ramp profiles, although other curvilinear profiles can be used.

Figure 8:
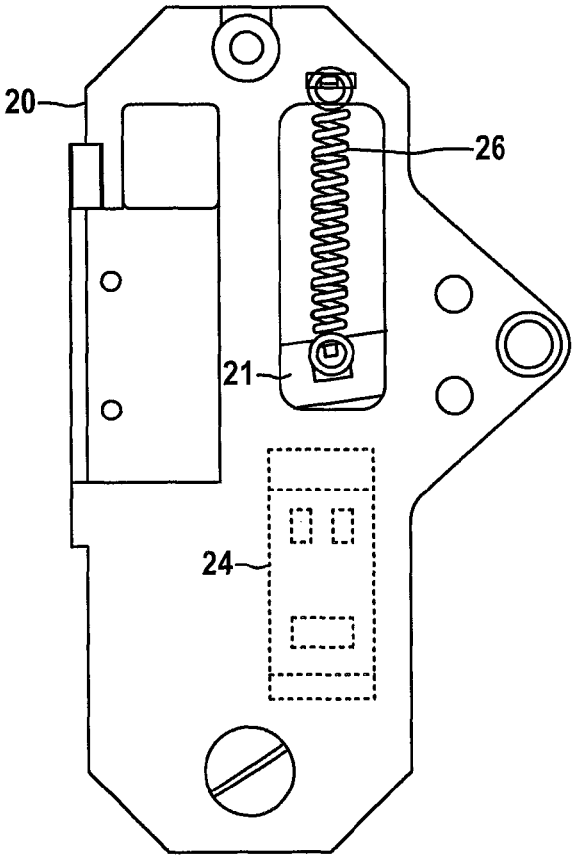
FIGS. 8 and 9 are bottom and top plan views, respectively, illustrating a feeding apparatus bracket assembly with a potentiometer, an opto-interrupt sensor, and a spring biased return arm for biasing the slidable member of the potentiometer against the profile edge of the first bracket in the feeding apparatus.
Figure 9:
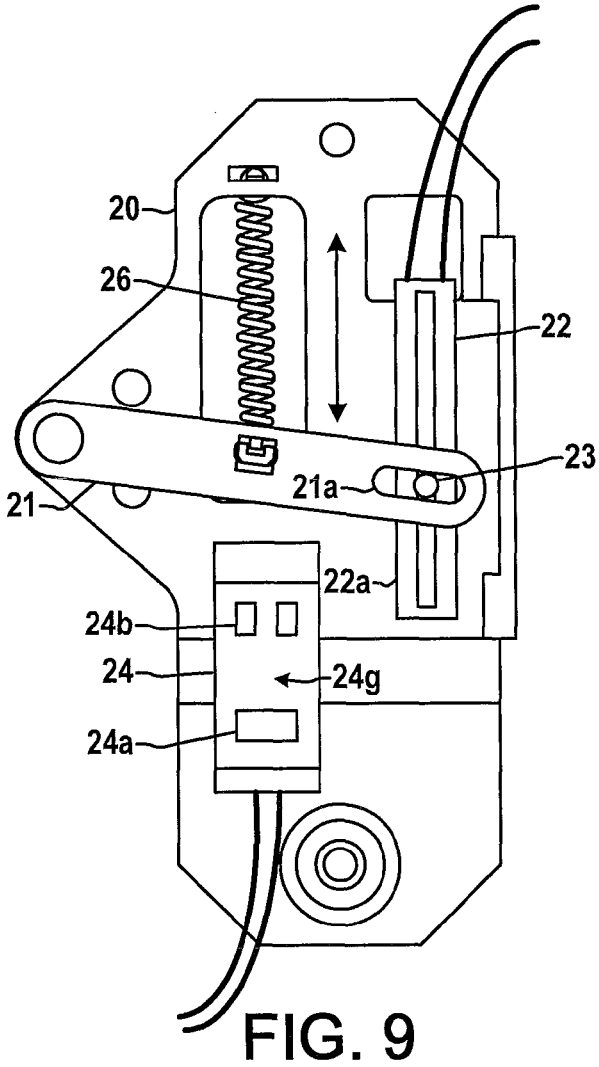

As shown in FIGS. 1, 8, and 9, a bracket 20 is mounted to the bottom side of the tray 10 and the potentiometer 22 and opto-interrupt sensor 24 are mounted to the bracket 20 along with a pivot arm 21 with a slot 21*a* for engaging with a slidable member 23 of the potentiometer 22 as the slidable member 23 moves relative to the potentiometer base 22*a*. Referring also to FIGS. 10-13, a spring 26 or other biasing structure is used to bias the pivot arm 21 upward relative to the bracket 20 whereby the slidable member 23 of the potentiometer 22 rides along the first and second profile portions 15*a* and 15*b* and radius center 15*c* of the ramp structure edge 15 of the first rack 16*a*. By this arrangement, movement of the media guide 12*a* relative to the tray 10 moves the potentiometer slide 23 along the first profile portion 15*a* in a first direction as the guide 12*a* is moved in a first portion of its movement range and then moves the slidable member 23 along the second profile portion 15*b* in a second (opposite) direction as the guide 12*a* continues in the same direction in a second portion of its movement or adjustment range. In this manner, the effective range of the potentiometer 22 is used twice for each full excursion of the media guide 12*a* thereby improving the resolution of the media width sensing apparatus.

Any suitable potentiometer 22 may be used, wherein a given potentiometer selection should take into account the force limitations of the corresponding slider 23 and the corresponding angle of incidence of the profiles 15*a* and 15*b* relative to the long axis of the potentiometer 22 to ensure proper performance of the potentiometer 22 in operation as a linear position transducer in a given printing system 2. In this regard, the relationships between the steepness of the profile angles relative to the potentiometer axis and the slider force ratings should be accounted for in a given design so as to provide a repeatable output voltage characteristic as a function of the separation distance between the media guides 12*a* and 12*b*, wherein the angle of incidence between the profile 15*a*, 15*b* and the potentiometer axis is related to the level of resolution provided by a given design, as balanced against the strength limitations of the potentiometer slider 23. In particular, one practical limit to the angle of incidence is the strength of the potentiometer slider and the force required to move the slider along the potentiometer, considering the various frictional forces attributable to the materials of the profile edges 15 and the slider 23 itself, as well as the biasing force that keeps the slider 23 engaged with the sloped profile edges 15. In the illustrated embodiments, the exemplary potentiometer 22 provides a stroke length of about 33 mm over which the slide 23 may be translated along the potentiometer axis, and the potentiometer 22 has a rated operating force of 0.25 N to move the sliding member 23 along the potentiometer axis, as well as a rated side push strength of 2 N before part failure. In this example, the design of the profile edges 15 and the material of the edges 15, as well as the biasing force applied by the spring 26 should provide sufficient force to move the slider 23 along the potentiometer axis when the guides 12 are moved relative to one another with sufficient spring force to ensure the slide 23 remains engaged with the profiled edges 15 at all times, while also ensuring that the side lateral force applied to the slider 23 does not exceed the side push strength rating of the potentiometer 22.

The illustrated implementation also includes an opto-interrupt sensor 24 mounted to the bottom side of the bracket 20 and thereby located in a fixed position relative to the tray 10. The opto-interrupt sensor 24 includes an optical signal source 24*a* (FIG. 9) providing an optical signal along an optical signal path and an optical signal detector 24*b* spaced from the source 24*a* by an optical sensing gap 24*g*, where the opto-interrupt sensor 22 provides an electrical output signal indicating whether or not the gap 24*g* is obstructed (i.e. whether or not the signal from the source 24*a* is received by the detector 24*b*). The first rack 16*a* (FIG. 6) also includes an optical obstruction structure with a single fin 19 that moves relative to the opto-interrupt sensor 24 when the guide 12*a* is moved relative to the tray 10, where the fin 19 moves within the optical sensing gap 24*g* to block the optical signal path for a first portion of the movement range of the guide 12*a* and then moves out of the gap 24*g* to allow receipt of the optical signal by the optical signal detector 24*b* for a second portion of the media guide movement range. Thus, the output signal from the opto sensor 22 will indicate which ramp portion 15*a* or 15*b* is currently engaged with the potentiometer slider 23 and a given media guide separation distance and corresponding registered media width or size can be derived based at least partially on the signals from the potentiometer 22 and the opto-interrupt sensor 24.

Figure 10:
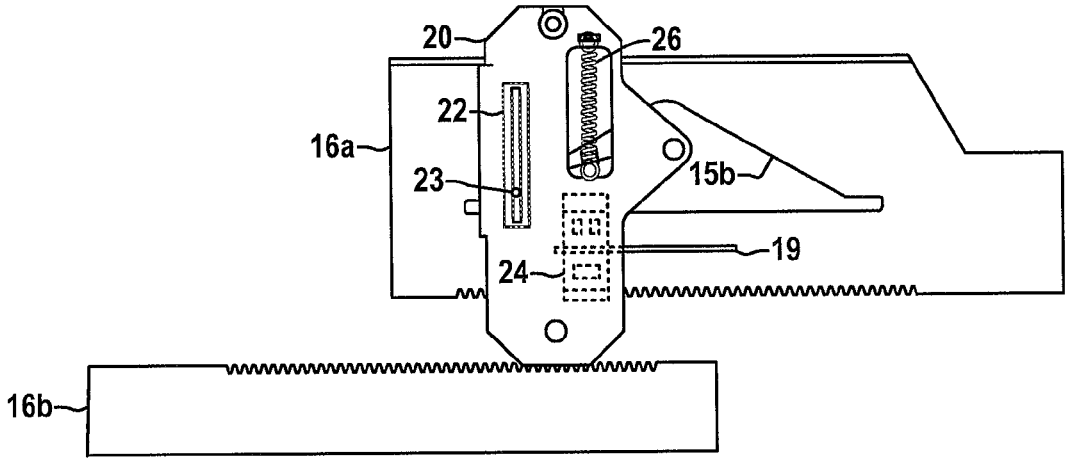
FIGS. 10-13 are partial bottom plan views illustrating operation of the feeding apparatus and media width sensing apparatus for different exemplary positions of the media guides.
Figure 11:
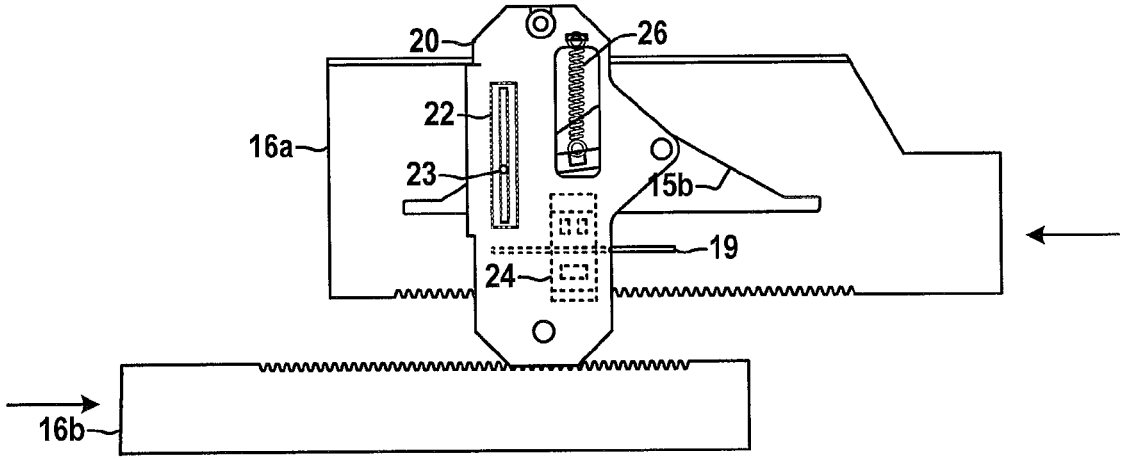
Figure 12:
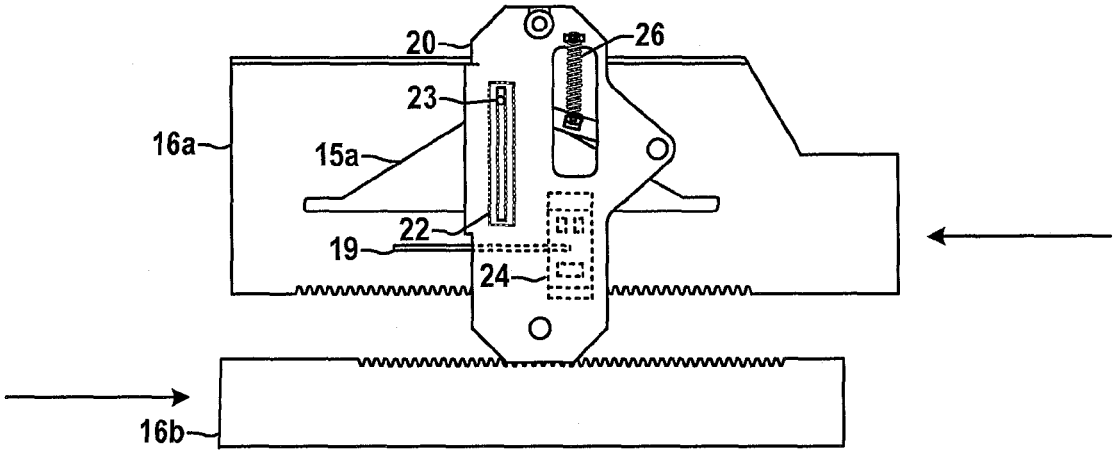
Figure 13:
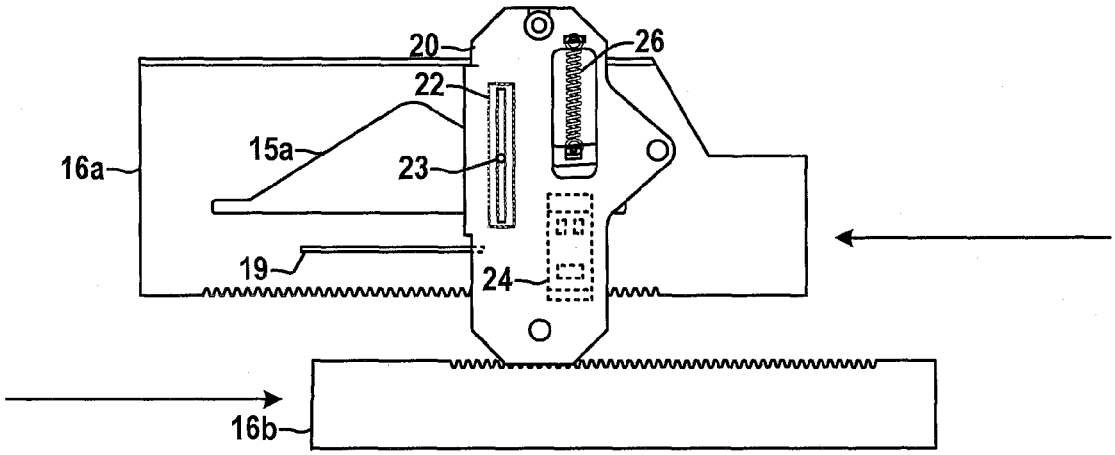

Referring to FIGS. 1 and 10-14, as the first guide 12*a* and the corresponding rack 16*a* move along their range of travel, the ramp profile 15 pushes the potentiometer slider 23 thus changing the output signal from the potentiometer 22. FIG. 10 illustrates one exemplary position of the guides, such as the full open position of FIG. 2 above, at which point the slider 23 is located near the beginning or low point of the first ramp profile portion 15*a* and the potentiometer output is at a low voltage. At this point, the fin 19 blocks the optical signal path in the gap 24*g* and the output of the opto-interrupt sensor 24 is at a low logic level (e.g., binary "0" in one example). As the guides 12 are moved inward to the position depicted in FIG. 11, the spring biasing causes the slider 23 to ride upward along the first profile portion 15*a* while the optical gap 24*g* remains blocked by the fin 17, whereby the binary output of the opto-interrupt sensor 24 remains low while the potentiometer output signal voltage increases. Upon further closure of the media guides 12*a* and 12*b* (FIGS. 3 and 12), the slider 23 travels up to the radius peak 15*c* at the transition from the first profile portion 15*a* to the second portion 15*b*, with the fin 19 eventually passing out of the optical signal path (with the output of the opto-interrupt sensor 24 transitioning to a high binary level or "1") as the potentiometer output signal reaches a maximum value. FIG. 13 illustrates another exemplary situation in the second movement range of the media guides 12, where additional media guide closure causes the translation of the sliding member 23 downward along the second profile portion 15*b*, thus reducing the potentiometer output signal with the opto-interrupt sensor output signal remaining high.

Figure 14:
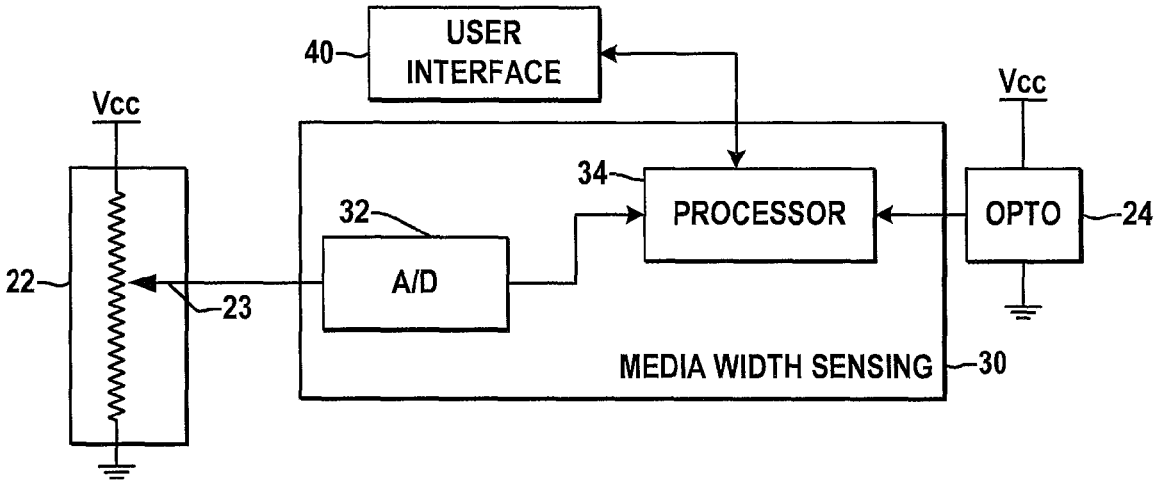
FIG. 14 is a simplified schematic drawing illustrating an exemplary media width sensing system with a processor coupled to receive output signals from the potentiometer and the opto-interrupt sensor as well as a user interface in the printing system.
Figure 15:
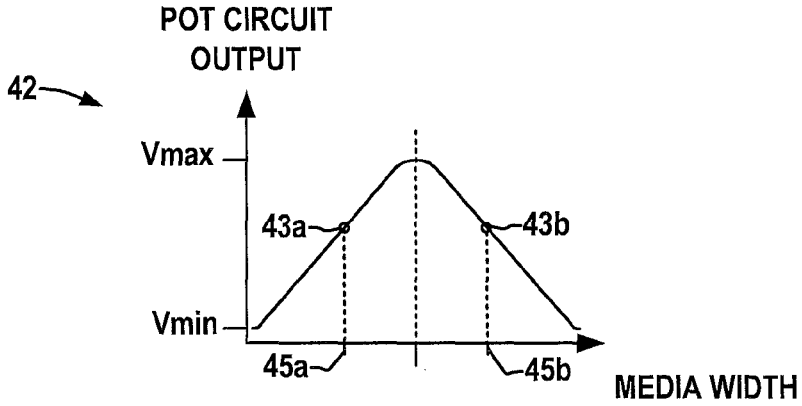
FIGS. 15 and 16 are graphs showing exemplary curves for potentiometer and opto sensor circuit outputs as a function of media width in the exemplary feeding apparatus.
Figure 16:
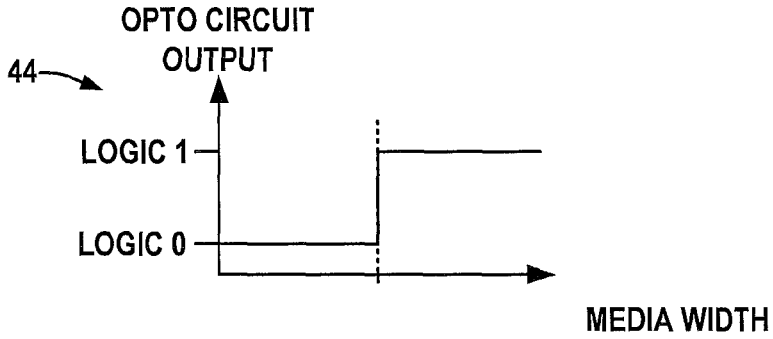

FIGS. 14-16 further illustrate the exemplary embodiment, in which a media width sensing system 30 is implemented in the printing system as a processor 34 operatively coupled to receive the output signal of the potentiometer 22 via an analog to digital converter 32 and also receives the Boolean output of the opto-interrupt sensor 24. The processor 34 is programmed or otherwise operative to determine the sensed media width based at least in part according to the electrical outputs of the potentiometer 22 and the opto-interrupt sensor 24, for instance, using the exemplary media width to output voltage curves 42 and 44 of FIGS. 15 and 16 for the potentiometer circuit output and opto-interrupt sensor circuit output, respectively. In this particular implementation, the processor 34 is programmed to read the output voltage of the potentiometer circuit and to select one of two possible points 43*a* or 43*b* on the curve 42 in FIG. 15 based on the state of the signal from the opto-interrupt sensor 24. In the example of FIGS. 15 and 16, if the output of the opto-interrupt sensor 24 is low or "0", the processor 34 determines that the potentiometer output signal is at point 43*a* in FIG. 15 and selects the corresponding media width distance value 45*a*. If, however, the opto-interrupt sensor output is high or "1", point 43*b* is selected and the processor 34 determines the media width (e.g., guide separation distance) as distance value 45*b*.

Figure 17:
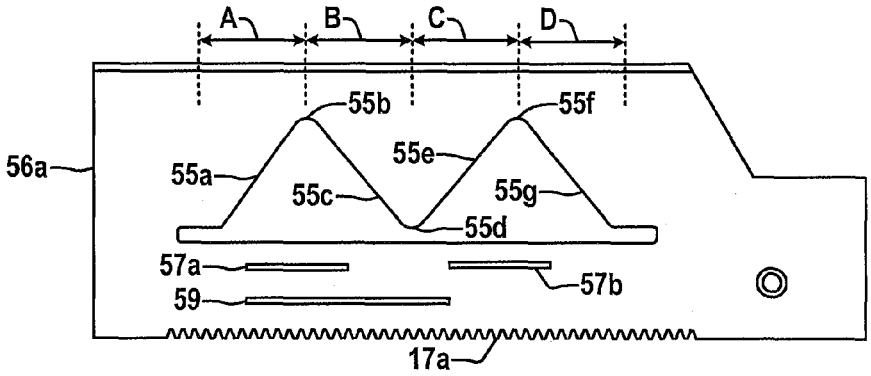
FIG. 17 is a bottom plan view illustrating another exemplary first rack associated with the first media guide having a quad ramp profile edge for translating the potentiometer slide and a pair of obstruction structures for selectively blocking or unblocking signal paths of two opto-interrupt sensors.
Figure 18:
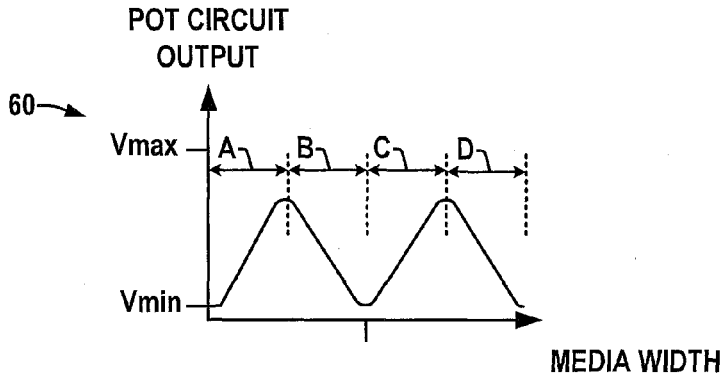
FIGS. 18-20 are graphs showing exemplary curves for potentiometer and opto sensor circuit outputs as a function of media width in the exemplary feeding apparatus using the rack of FIG. 17 and two opto-interrupt sensors.
Figure 19:
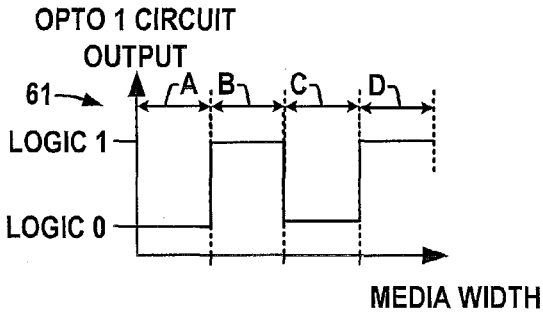
Figure 20:
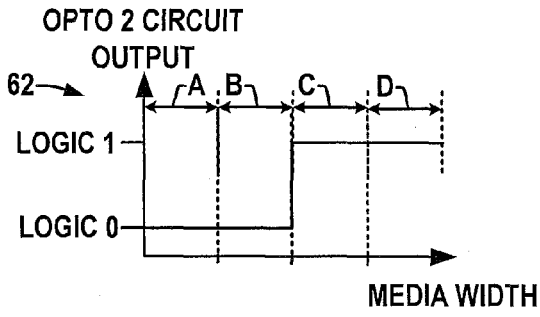
Figure 21:
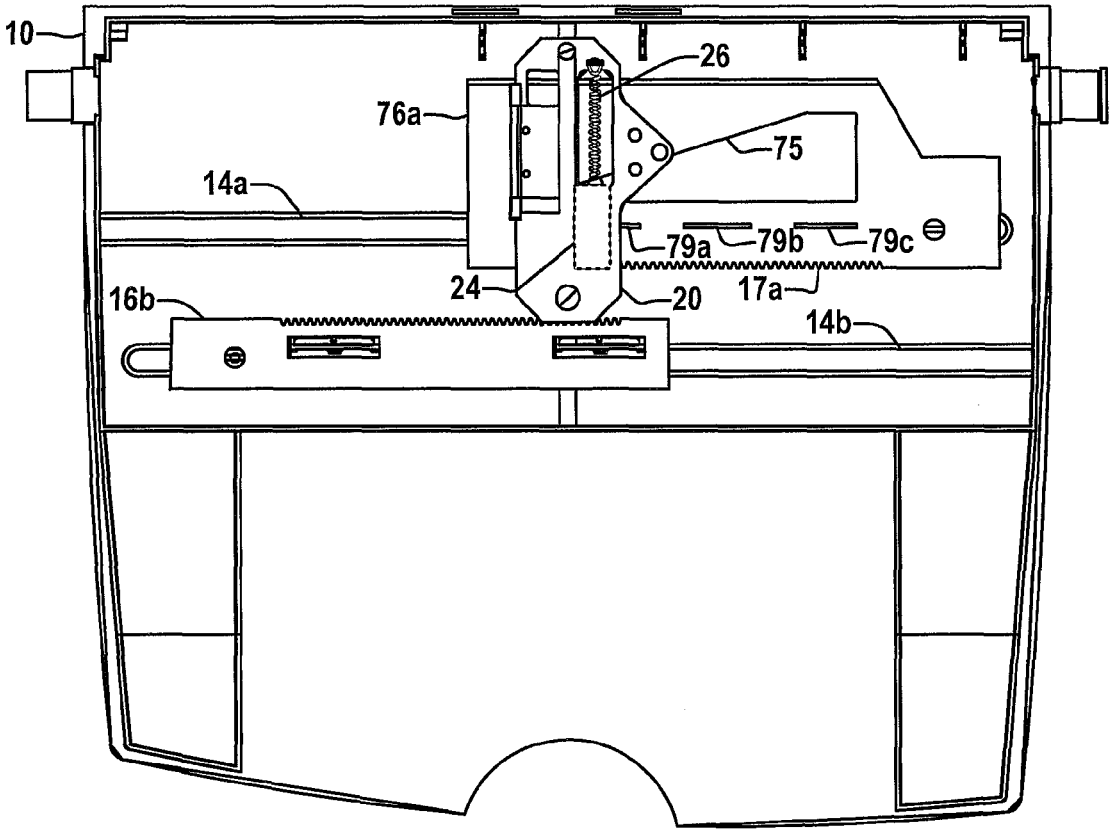
FIG. 21 is a bottom plan view illustrating another exemplary printing system feeding apparatus including a tray and a media width sensing apparatus with a potentiometer and an opto-interrupt sensor.
Figure 22:
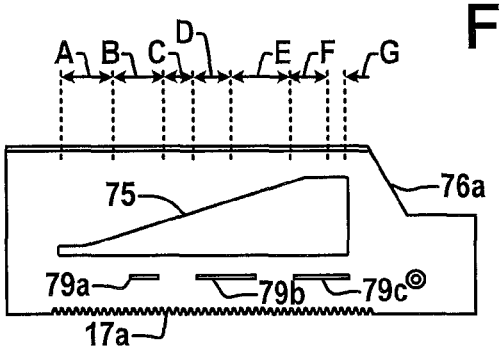
FIGS. 22 and 23 are bottom plan and perspective views illustrating an exemplary first rack in the media width sensing apparatus of FIG. 21 including a multi-fin arrangement providing identification of seven distinct media width ranges.
Figure 23:
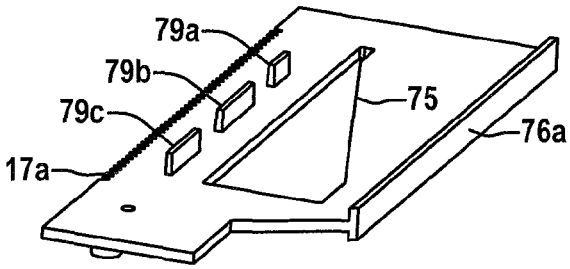

Referring now to FIGS. 17-20, the above illustrated concept is extendable to use of further profiles and additional opto-interrupt sensors to utilize the potentiometer sensing range any number of times over the movement range of the media guides 12 and thus to improve the media width sensing resolution. FIG. 17 shows another exemplary embodiment of a first rack 56*a* associated with the first media guide 12*a*, in this case including a quad ramp profile edge 55 with ramp profile portions 55*a*, 55*c*, 55*e*, and 55*g* separated by radiused transitions 55*b*, 55*d*, and 55*f* for translating the potentiometer slide 23 four times over the media guide adjustment range, as well as a pair of obstruction structures 57, 59 for selectively blocking or unblocking signal paths of two opto-interrupt sensors mounted on the bracket 20 (not shown). FIGS. 18-20 provide graphs 60-62 showing exemplary curves for potentiometer and opto sensor circuit outputs as a function of media width in the exemplary feeding apparatus using the rack 56*a* of FIG. 17.

The obstruction structure 57 in this embodiment includes first and second fins 57*a* and 57*b* for selectively blocking or opening an optical signal path of a first opto-interrupt sensor, such as sensor 24 mounted on bracket 20 in FIGS. 8 and 9 above. The second obstruction structure includes a single fin 59 essentially bifurcating the travel range of the first media guide 12*a* into first and second portions A/B and C/D by blocking the optical path of a corresponding second opto-interrupt sensor (not shown) also mounted on the bracket 20 over the first guide travel range portion A/B and allowing unobstructed passage of the optical signal thereof in the second range portion C/D. The fins 57*a* and 57*b* operate to segment each of these travel range portions into two sub portions, wherein each of the four partitioned sub portions A, B, C, and D corresponds to one excursion of the potentiometer 22. In this manner, the media width sensing system 30 (FIG. 14 above) can determine the current positional sub portion from the output signals of the opto-interrupt sensors 24 and then determine the current position within the sub portion based on the output of the potentiometer 22.

In the above examples the profile portions 15, 55 are substantially equal linear ramp shapes and the fins 19, 57, 59 are of lengths set to correspond to an integer number of transitions of the potentiometer 22. However, alternate implementations are contemplated in which unequal length and/or non-linear profiles are used and in which the fins may be of unequal lengths. The above described examples, moreover, may be employed in calibrated or non-calibrated systems for determining media widths and for registering media being fed into a printing system. Furthermore, while the illustrated examples are described in connection with media feeding systems employing two oppositely adjustable synchronously translating rack and pinion type guide assemblies, other embodiments are possible in which one guide 12 is stationary while the other is translatable with suitable mounting of a potentiometer 22 to have a sliding member thereof move as the movable guide 12 moves relative to the tray along with one or more opto-interrupt sensors 24 and corresponding obstruction structures situated such that optical signal paths thereof are blocked over a portion of the guide travel range and are exposed in another range portion.

Another embodiment of the present disclosure is depicted in FIGS. 21-32 in which an opto-interrupt sensor 24 mounted on the bracket 20 encounters three fins 79*a*, 79*b*, and 79*c* on a first guide rack 76*a* (as well as unobstructed spaces therebetween) through a single traverse of the guide adjustment range with the potentiometer 22 being translated by a single ramp profile 75 of the rack 76*a* by which the potentiometer output signal range is effectively partitioned or divided into seven sub ranges or portions A-G. This embodiment employs a single opto-interrupt sensor 24 mounted to the bracket 20 as in FIGS. 8 and 9 above, along with a single potentiometer 22. This implementation, moreover, may be tailored to provide calibration-free operation to localize or isolate groupings of standard media widths within each of the portions A-G through corresponding selection or tailoring of the lengths and locations of the fins 79 and the spacings therebetween.

In one possible embodiment the combination of the potentiometer output voltage and the state of the opto-interrupt sensor 24 facilitates differentiation to identify the current positional portion or region A, B, C, D, E, F, or G, by which the width determination system 30 (FIG. 14) can infer a set of possible standard media sizes while factoring in mechanical and/or electrical system tolerances, and then either proceed with a default selection or present these possible sizes for confirmation by an operator via the user interface 40 (also in FIG. 14). In this respect, while the illustrated example includes three fins 79*a*-79*c* with unequal lengths and uneven spacing, any number of such fins may be employed in other embodiments in accordance with the present disclosure, having any suitable lengths and spacings, wherein these parameters may be tailored to define media width ranges to isolate groups of expected standard media sizes taking into consideration mechanical and electrical tolerances of a given media width sensing system. In this manner, the system may be operable without calibration, wherein the granularity of the groupings may be selected to account for worst case tolerance variations and known or expected standard media width sizes.

Figure 24:
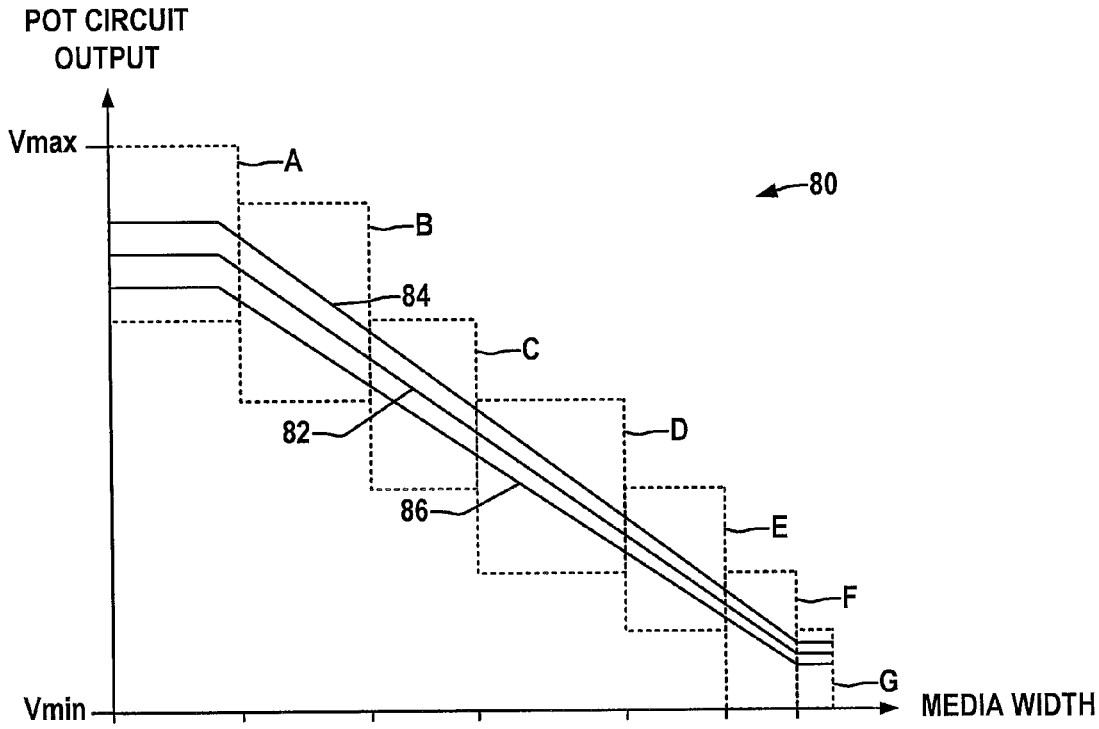
FIGS. 24 and 25 are graphs showing exemplary potentiometer and opto-interrupt sensor circuit outputs as a function of media width in the exemplary feeding apparatus of FIGS. 21-23.

As shown in FIG. 24, the potentiometer 22 in the illustrated embodiment provides an output with a single transition between a maximum output Vmax and a minimum output Vmin as the media guides 12 are adjusted across their adjustment range by virtue of the single ramp profile 75 of the rack 76*a*, with the graph 80 of FIG. 24 illustrating a nominal potentiometer output curve 82 as well as maximum and minimum curves 84 and 86, respectively, corresponding to maximum and minimum tolerance shifts in the electrical and mechanical width detection system. In this implementation, moreover, the locations, lengths, and spacings of the three exemplary obstruction fins 79*a*-79*c* provide for differentiating between the seven media width detection regions A-G that are large enough to each encompass the entire tolerance range of the potentiometer output (all three curves 82, 84, and 86) to avoid ambiguity in width detection, even in the absence of system calibration. Furthermore, the regions A-G each include one or more standard media widths where the boundaries between the regions A-G are located along the media width axis so as to avoid ambiguity in identifying the standard media sizes of a particular region to be verified by user selection.

In this example for a 3.3 VDC power supply, the first region A defines a media width range of about 102 mm or more and about 124 mm or less with a potentiometer voltage range of about 2.6913 volts or more to 3.5000 volts or less, region B corresponds to a width range of about 124 mm or more and about 168 mm or less with a potentiometer voltage range of about 2.1346 volts or more to 3.5000 volts or less, region C defines a media width range of about 168 mm or more and about 204 mm or less with a potentiometer voltage range of about 1.5225 volts or more to 2.6913 volts or less, region D corresponds to a width range of about 204 mm or more and about 254 mm or less with a potentiometer voltage range of about 0.9426 volts or more to 2.1346 volts or less, region E defines a width range of about 254 mm or more and about 288 mm or less with a potentiometer voltage range of about 0.5415 volts or more to 1.5225 volts or less, region F defines a width range of about 288 mm or more and about 312 mm or less with a potentiometer voltage range of about 0.0000 volts or more to 0.9426 volts or less, and region G corresponds to a width range of about 312 mm or more and about 322 mm or less with a potentiometer voltage range of about 0.0000 volts or more to 0.5415 volts or less.

Figure 25:
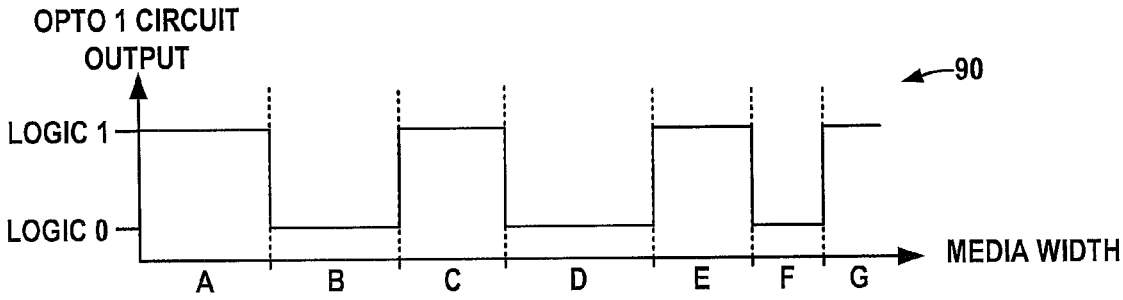
Figure 26:
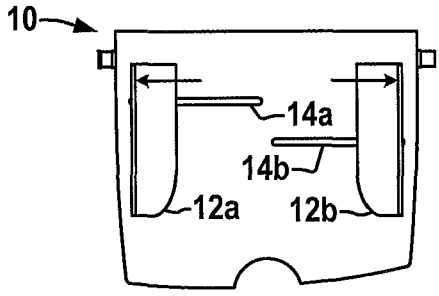
FIGS. 26-32 are top plan views of the media feeding apparatus illustrating the media guides positioned in the seven distinct media width ranges.
Figure 27:
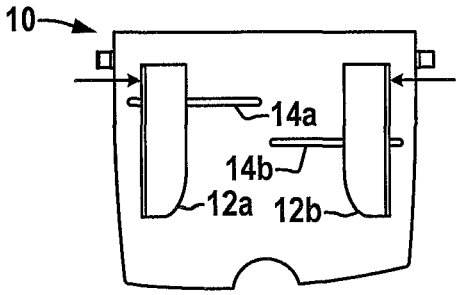
Figure 28:
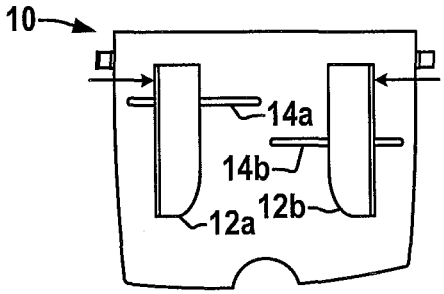
Figure 29:
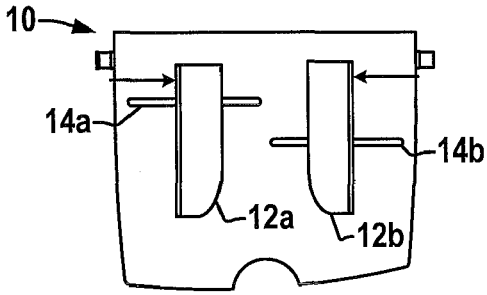
Figure 30:
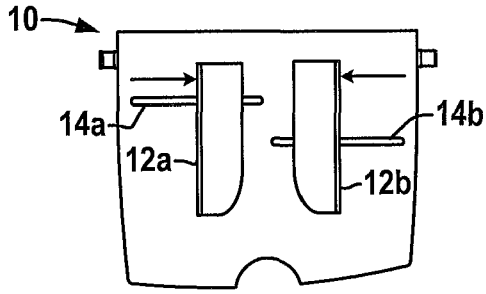
Figure 31:
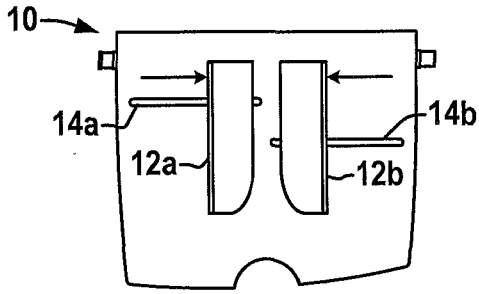
Figure 32:
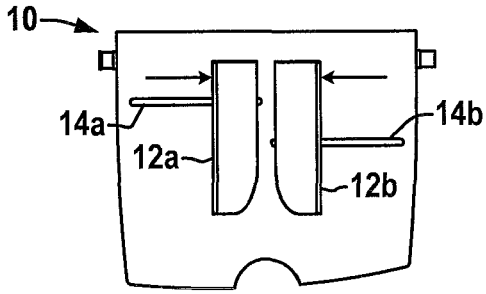

The width detection system 30 (FIG. 14) reads the output voltage from the potentiometer circuit 22 and determines the region based on the potentiometer voltage and the opto-interrupt sensor output as shown in the graph 90 of FIG. 25 to ascertain the current region. In this example, the opto output for region A is Boolean "1", region B is "0", region C is "1", region D is "0", region E is "1" region F is "0", and region G is "1". Thus, for a potentiometer output voltage value that can overlap two adjacent regions (e.g., 2.500 volts in this embodiment), the detection system 30 is configured to select region B if the output of the opto-interrupt sensor 24 is "0" and to select region C if the opto output is "1", thereby disambiguating the identity of the current region while taking into account the tolerances of the electro mechanical system. In one example, these tolerances include without limitation a five percent variation on the potentiometer input voltage supply (e.g. 3.3 VDC+/−5%), two-dimensional mechanical tolerance on the positioning of the potentiometer 22, mechanical tolerance in the relative location of the media guides 12*a* and 12*b*, a 1 mm cut tolerance on the width of the inserted media itself, and tolerances in the potentiometer sensor performance. These tolerances can be addressed through system calibration or alternatively, the system can be operated without calibration since the combination of the potentiometer output and the output of the opto-interrupt sensor 24 provide for distinguishing the regions A-G in unambiguous fashion for the max, min, and nominal potentiometer output voltage curves 84, 86, and 82, respectively, in the graph 80 of FIG. 24.

The exemplary regions A-G is the embodiment of FIGS. 21-25, moreover, each include one or more standard media sizes for sheet media, envelopes, etc., where FIGS. 26-32 illustrate top views of the media feeding tray 10 and the media guides 12 positioned within the seven distinct media width regions A-G, respectively. In this example, the region A includes ENV US#10 SEF (US default) and ENV DL SEF (European default) media; region B includes STATEMENT SEF (US default) A5 SEF (European default), ENV C5 SEF, and ENV 6×9 SEF media; region C includes EXECUTIVE (US default) media; region D includes LETTER SEF (US default), A4 SEF (European default), ENV C4 SEF, and ENV 9×12 SEF media; region E includes LETTER LEF (US default) and TABLOID SEF media; region F includes TABLOID EXTRA SEF (US default), A4 LEF (European default), and A3 SEF media; and region G includes SRA3 SEF (European default) media. In one possible implementation of this embodiment, the software employed by the processor 34 in the width detection system 30 (FIG. 14) may include a lookup table to define the above regions and the associated voltage ranges and opto output states to uniquely identify the current adjustment region. In this example, for regions with more than one standard media size, the system controller 34 can present a default choice to the operator via the user interface 40 (FIG. 14), where the default can be based on media common to the market in which the printing system 2 is installed (e.g. a US machine defaults to the above US media sizes, a European system renders the above European defaults, etc.), and the interface 40 may present the user with other choices within the given region. The operator can then proceed with the default, or select from the list of media sizes within the current region, or may be allowed to override the system choices and enter another media width.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the invention. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A media feeding apparatus for a printing system, comprising:

a tray supporting media to be fed into the printing system;

first and second media guides operatively coupled to the tray for engaging opposite sides of the media to position the media on the tray, the first media guide being movable relative to the tray along an axis;

a potentiometer with a base mounted in a fixed position relative to the tray and a slidable member operatively coupled to the first media guide to move relative to the base when the first media guide is moved relative to the tray, the potentiometer providing an electrical output signal indicative of the relative position of the first media guide and the tray;

an opto-interrupt sensor mounted in a fixed position relative to the tray and having an optical signal source providing an optical signal along an optical signal path and an optical signal detector spaced from the optical signal source by an optical sensing gap, the opto-interrupt sensor providing an electrical output signal indicative of the presence or absence of an optical obstruction in the gap;

an optical obstruction structure operatively coupled to the first media guide to move relative to the opto-interrupt sensor when the first media guide is moved relative to the tray, the optical obstruction structure including at least a first fin movable within the optical sensing gap to block the optical signal path for a first portion of the movement range of the first media guide and to allow receipt of the optical signal by the optical signal detector for a second portion of the movement range of the first media guide;

a ramp structure mounted in a fixed position relative to the first media guide and having an edge for engaging the slidable member of the potentiometer, the ramp structure edge having a profile at an angle to the axis to move the slidable member of the potentiometer relative to the base when the first media guide is moved relative to the tray; and a biasing structure to bias the slidable member against the edge of the ramp structure as the first media guide is moved relative to the tray.

2. The media feeding apparatus of claim 1, wherein the first and second media guides are both movable relative to the tray along the axis.

3. The media feeding apparatus of claim 1, wherein the profile of the ramp structure edge comprises first and second profile portions to move the slidable member along the first profile portion in a first direction as the first media guide is moved in the first portion of the movement range and to move the slidable member along the second profile portion in a second direction as the first media guide is moved in the second portion of the movement range.

4. The media feeding apparatus of claim 3, wherein the profile portions of the ramp structure edge are substantially straight ramp profiles.

5. The media feeding apparatus of claim 1, further comprising:

a second opto-interrupt sensor mounted in a fixed position relative to the tray and having an optical signal source providing an optical signal along a second optical signal path and an optical signal detector spaced from the optical signal source by an optical sensing gap, the second opto-interrupt sensor providing an electrical output signal indicative of the presence or absence of an optical obstruction in the second gap; and a second optical obstruction structure operatively coupled to the first media guide to move relative to the second opto-interrupt sensor when the first media guide is moved relative to the tray, the second optical obstruction structure including at least one fin movable within the second optical sensing gap to block the optical signal path for one portion of the movement range of the first media guide and to allow receipt of the optical signal by the optical signal detector for another portion of the movement range of the first media guide.

6. The media feeding apparatus of claim 1, wherein the optical obstruction structure comprises a second fin spaced from the first fin and movable within the optical sensing gap to block the optical signal path for a third portion of the movement range of the first media guide.

7. The media feeding apparatus of claim 6, wherein the sizing and spacing of the first and second fins is tailored according to standard media sizes.

8. The media feeding apparatus of claim 1, comprising a media width sensing system operatively coupled with the potentiometer and the opto-interrupt sensor and operative to determine a width of media registered between the media guides based at least partially on the electrical output signals from the potentiometer and the opto-interrupt sensor.

9. The media feeding apparatus of claim 8, wherein the media width sensing system is operative to provide a selection of possible media widths to a user interface of the printing system based on the electrical output signals from the potentiometer and the opto-interrupt sensor.

10. A system for determining a width of media registered between first and second media guides in a feeding tray of a printing system; comprising:

a potentiometer with a base mounted in a fixed position relative to the tray and a slidable member operatively coupled to the first media guide to move relative to the base when the first media guide is moved relative to the tray, the potentiometer providing an electrical output signal indicative of the relative position of the first media guide and the tray;

an opto-interrupt sensor mounted in a fixed position relative to the tray and having an optical signal source providing an optical signal along an optical signal path and an optical signal detector spaced from the optical signal source by an optical sensing gap, the opto-interrupt sensor providing an electrical output signal indicative of the presence or absence of an optical obstruction in the gap;

an optical obstruction structure operatively coupled to the first media guide to move relative to the opto-interrupt sensor when the first media guide is moved relative to the tray, the optical obstruction structure including at least a first tin movable within the optical sensing gap to block the optical signal path for a first portion of the movement range of the first media guide and to allow receipt of the optical signal by the optical signal detector for a second portion of the movement range of the first media guide;

a media width sensing system operatively coupled with the potentiometer and the opto-interrupt sensor and operative to determine a width of media registered between the media guides based at least partially on the electrical output signals from the potentiometer and the opto-interrupt sensor;

a ramp structure mounted in a fixed position relative to the first media guide and having an edge for engaging the slidable member of the potentiometer, the ramp structure edge having a profile to move the slidable member of the potentiometer relative to the base as the first media guide moves relative to the tray; and a biasing structure to bias the slidable member against the edge of the ramp structure as the first media guide is moved relative to the tray.

11. The system of claim 10, wherein the media width sensing system is operative to provide a selection of possible media widths to a user interface of the printing system based on the electrical output signals from the potentiometer and the opto-interrupt sensor.

12. The system of claim 10, wherein the profile of the ramp structure edge profile comprises first and second profile portions to move the slidable member along the first profile portion in a first direction as the first media guide is moved in the first portion of the movement range and to move the slidable member along the second profile portion in a second direction as the first media guide is moved in the second portion of the movement range.

13. The system of claim 10, further comprising:

a second opto-interrupt sensor mounted in a fixed position relative to the tray and having an optical signal source providing an optical signal along a second optical signal path and an optical signal detector spaced from the optical signal source by an optical sensing gap, the second opto-interrupt sensor providing an electrical output signal indicative of the presence or absence of an optical obstruction in the second gap; and a second optical obstruction structure operatively coupled to the first media guide to move relative to the second opto-interrupt sensor when the first media guide is moved relative to the tray, the second optical obstruction structure including at least one fin movable within the second optical sensing gap to block the optical signal path for one portion of the movement range of the first media guide and to allow receipt of the optical signal by the optical signal detector for another portion of the movement range of the first media guide.

14. The system of claim 10, wherein the optical obstruction structure comprises a second fin spaced from the first fin and movable within the optical sensing gap to block the optical signal path for a third portion of the movement range of the first media guide.

15. A method of determining a media width in a printing system, the method comprising:

providing a tray with first and second media guides for engaging opposite sides of media supported in the tray;

mounting a potentiometer in a fixed position relative to the tray and having a slidable member operatively coupled to the first media guide to move when the first media guide is moved relative to the tray;

mounting an opto-interrupt sensor in a fixed position relative to the tray, the opto-interrupt sensor having an optical signal source providing an optical signal along an optical signal path and an optical signal detector spaced from the optical signal source by an optical sensing gap, the opto-interrupt sensor providing an electrical output signal indicative of the presence or absence of an optical obstruction in the gap;

mounting an optical obstruction structure in a fixed position relative to the first media guide to move relative to the opto-interrupt sensor when the first media guide is moved relative to the tray, the optical obstruction structure including at least a first fin movable within the optical sensing gap to block the optical signal path for a first portion of the movement range of the first media guide and to allow receipt of the optical signal by the optical signal detector for a second portion of the movement range of the first media guide;

moving the first media guide to engage opposite sides of the media with the first and second media guides;

reading a first electrical signal from the potentiometer;

reading a second electrical signal from the opto-interrupt sensor;

determining a width of the media registered between the media guides based at least partially on the first and second electrical signals;

mounting a ramp structure in a fixed position relative to the first media guide, the ramp structure having an edge for engaging the slidable member of the potentiometer, the ramp structure edge having a profile at an angle to the axis to move the slidable member of the potentiometer relative to the base when the first media guide is moved relative to the tray; and biasing the slidable member against the edge of the ramp structure as the first media guide is moved relative to the tray.

16. The method of claim 15, wherein determining the width of the media comprises:

determining a plurality of possible media widths based on the electrical output signals from the potentiometer and the opto-interrupt sensor;

rendering a selection of the plurality of possible media widths to a user; and determining the media width based on a user selection from a user interface of the printing system.

17. The method of claim 15, comprising:

mounting a second opto-interrupt sensor in a fixed position relative to the tray, the second opto-interrupt sensor having an optical signal source providing an optical signal along a second optical signal path and an optical signal detector spaced from the optical signal source by an optical sensing gap, the second opto-interrupt sensor providing an electrical output signal indicative of the presence or absence of an optical obstruction in the second gap;

mounting a second optical obstruction structure in a fixed position relative to the first media guide to move relative to the second opto-interrupt sensor when the first media guide is moved relative to the tray, the second optical obstruction structure including at least one fin movable within the second optical sensing gap to block the optical signal path for one portion of the movement range of the first media guide and to allow receipt of the optical signal by the optical signal detector for another portion of the movement range of the first media guide;

reading a third electrical signal from the second opto-interrupt sensor; and determining the media width based at least partially on the first, second, and third electrical signals.

18. The method of claim 15, wherein the optical obstruction structure comprises a second tin spaced from the first tin and movable within the optical sensing gap to block the optical signal path for a third portion of the movement range of the first media guide.

19. The method of claim 15, wherein the width of the media comprises determining a standard media width from a list of one or more standard media widths associated with a region uniquely defined by the first and second electrical signals.

20. A media feeding apparatus for a printing system, comprising:

a tray supporting media to be fed into the printing system;

first and second media guides operatively coupled to the tray for engaging opposite sides of the media to position the media on the tray, the first media guide being movable relative to the tray along an axis;

a potentiometer with a base mounted in a fixed position relative to the tray and a slidable member operatively coupled to the first media guide to move relative to the base when the first media guide is moved relative to the tray, the potentiometer providing an electrical output signal indicative of the relative position of the first media guide and the tray;

an opto-interrupt sensor mounted in a fixed position relative to the tray and having an optical signal source providing an optical signal along an optical signal path and an optical signal detector spaced from the optical signal source by an optical sensing gap, the opto-interrupt sensor providing an electrical output signal indicative of the presence or absence of an optical obstruction in the gap; and an optical obstruction structure operatively coupled to the first media guide to move relative to the opto-interrupt sensor when the first media guide is moved relative to the tray, the optical obstruction structure including at least a first fin movable within the optical sensing gap to block the optical signal path for a first portion of the movement range of the first media guide and to allow receipt of the optical signal by the optical signal detector for a second portion of the movement range of the first media guide;

wherein the optical obstruction structure comprises a second tin spaced from the first fin and movable within the optical sensing gap to block the optical signal path for a third portion of the movement range of the first media guide; and wherein the sizing and spacing of the first and second fins is tailored according to standard media sizes.

21. The media feeding apparatus of claim 20, further comprising:

a second opto-interrupt sensor mounted in a fixed position relative to the tray and having an optical signal source providing an optical signal along a second optical signal path and an optical signal detector spaced from the optical signal source by an optical sensing gap, the second opto-interrupt sensor providing an electrical output signal indicative of the presence or absence of an optical obstruction in the second gap; and a second optical obstruction structure operatively coupled to the first media guide to move relative to the second opto-interrupt sensor when the first media guide is moved relative to the tray, the second optical obstruction structure including at least one fin movable within the second optical sensing gap to block the optical signal path for one portion of the movement range of the first media guide and to allow receipt of the optical signal by the optical signal detector for another portion of the movement range of the first media guide.

22. The media feeding apparatus of claim 20, comprising a media width sensing system operatively coupled with the potentiometer and the opto-interrupt sensor and operative to determine a width of media registered between the media guides based at least partially on the electrical output signals from the potentiometer and the opto-interrupt sensor.

* * * * *